United States Patent [19]

Merjan

[11] 4,199,277

[45] * Apr. 22, 1980

[54] PILING

[76] Inventor: Stanley Merjan, 16 Beacon Dr., Port Washington, N.Y. 11050

[ * ] Notice: The portion of the term of this patent subsequent to Jan. 2, 1995, has been disclaimed.

[21] Appl. No.: 959,630

[22] Filed: Nov. 13, 1978

Related U.S. Application Data

[60] Continuation of Ser. No. 745,405, Nov. 26, 1976, Pat. No. 4,132,082, which is a division of Ser. No. 601,728, May 4, 1975, abandoned, said Ser. No. 601,728, is a division of Ser. No. 303,706, Nov. 6, 1972, Pat. No. 3,913,337, which is a continuation-in-part of Ser. No. 256,163, May 23, 1972, Pat. No. 3,875,752, and Ser. No. 235,790, Mar. 17, 1972, Pat. No. 3,751,931, said Ser. No. 235,790, is a continuation-in-part of Ser. No. 97,997, Dec. 4, 1970, abandoned.

[51] Int. Cl.[2] ..... E02D 5/30; E02D 5/48; E02D 5/50

[52] U.S. Cl. ..... 405/251; 32/170; 405/250; 405/253

[58] Field of Search ..... 405/253, 244, 231, 237, 405/245, 246, 249, 232, 250, 251, 252, 253, 255, 256; 52/170, 297, 298; 175/21

[56] References Cited

U.S. PATENT DOCUMENTS

| | | | |
|---|---|---|---|
| 1,778,925 | 10/1930 | Thornlry | 405/253 |
| 2,065,507 | 12/1936 | Alexander | 405/252 |
| 2,187,318 | 1/1940 | Grevlich | 405/256 |
| 3,751,931 | 8/1973 | Merjian | 405/253 |

*Primary Examiner*—Alexander Grosz
*Attorney, Agent, or Firm*—Abner Sheffer

[57] ABSTRACT

A concrete pile fitted with a special slightly tapered concrete tip of larger area. The tip has a central open socket for receiving concrete poured in after the pile is in place.

5 Claims, 11 Drawing Figures

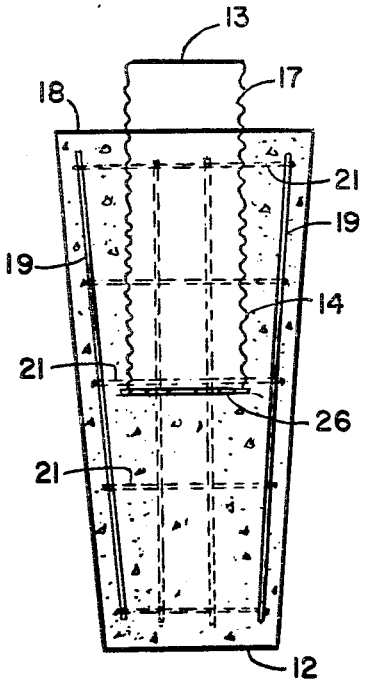
FIG. 1
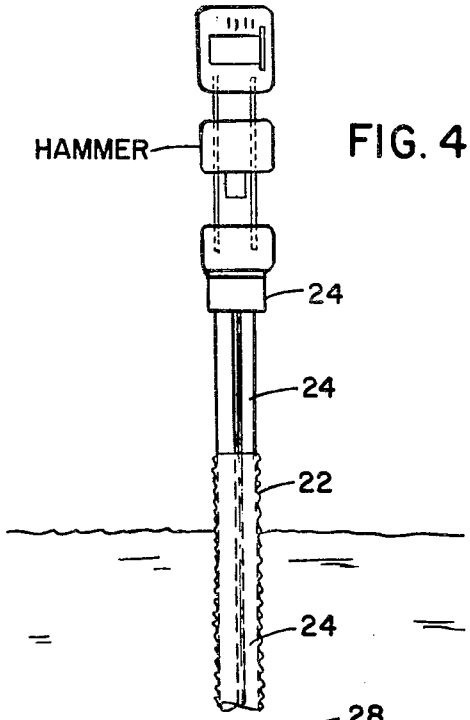
FIG. 4
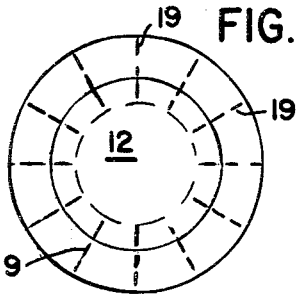
FIG. 2
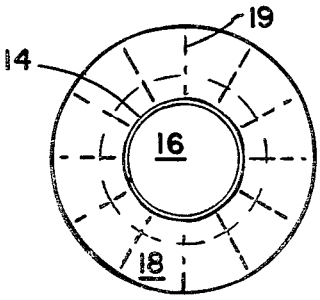
FIG. 3
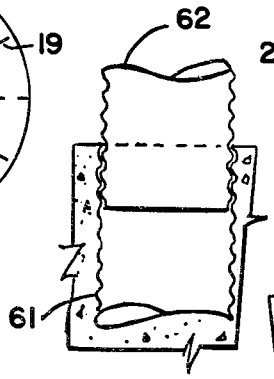
FIG. 11
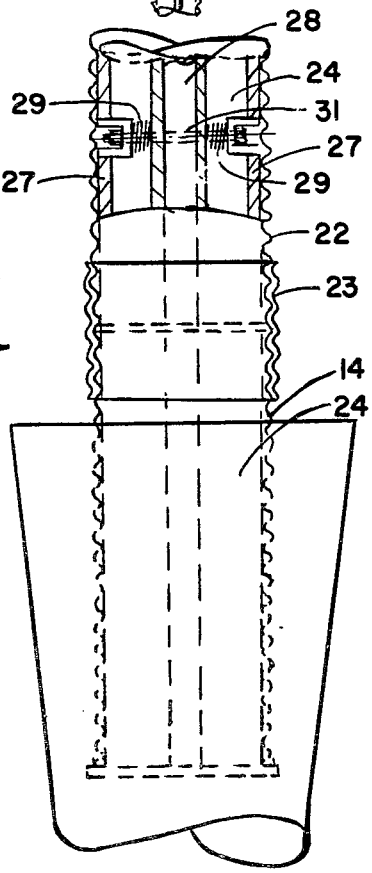

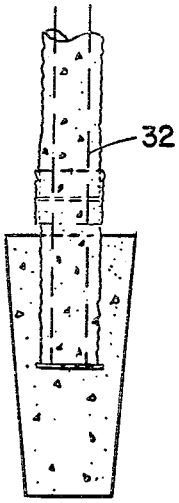
FIG. 5
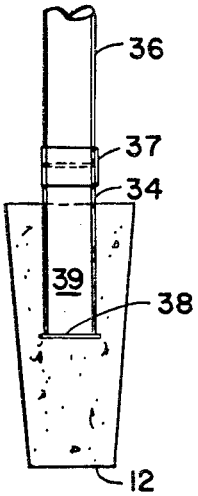
FIG. 6
FIG. 9
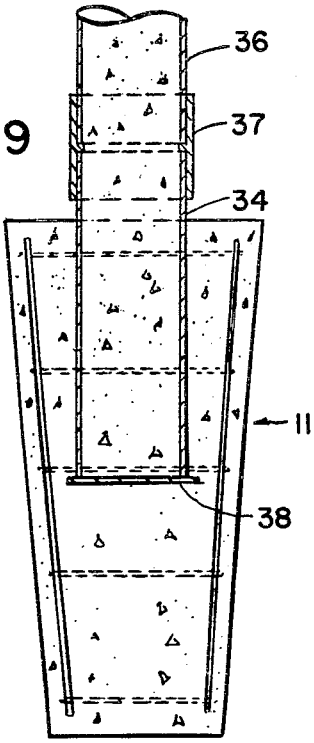
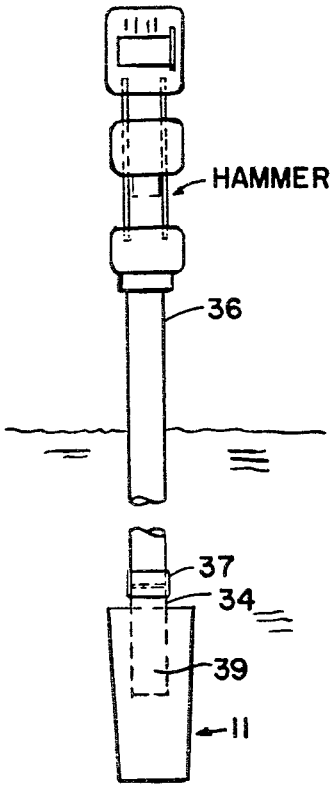
FIG. 7
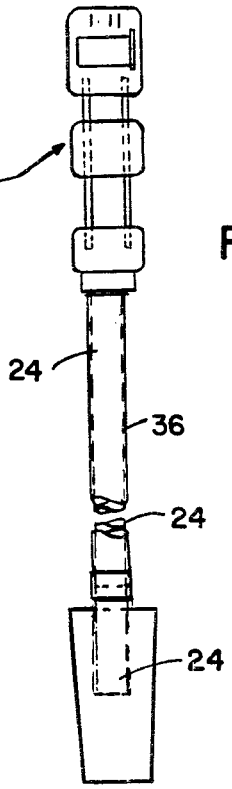
FIG. 8
FIG. 10
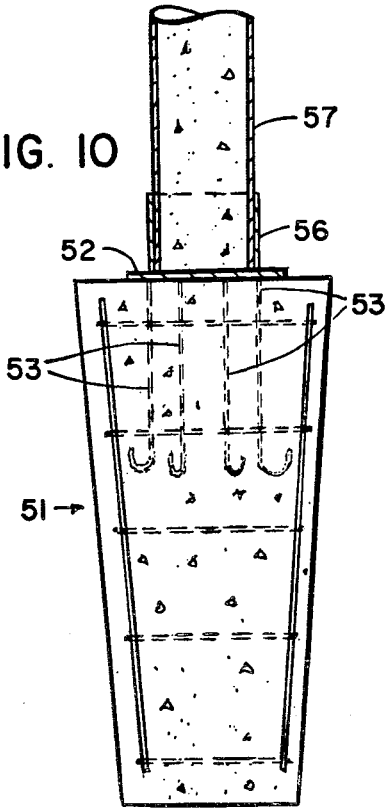

PILING

This application is a continuation of application Ser. No. 745,405, filed Nov. 26, 1976, now U.S. Pat. No. 4,132,082, which is a division of application Ser. No. 601,728, filed May 4, 1975 and now abandoned. Said application Ser. No. 601,728 is a division of application Ser. No. 303,706, filed Nov. 6, 1972, now U.S. Pat. No. 3,913,337, which is a continuation-in-part of both applications Ser. No. 256,163, filed May 23, 1972, now U.S. Pat. No. 3,875,752, and application Ser. No. 235,790, filed Mar. 17, 1972, now U.S. Pat. No. 3,751,931. Said application Ser. No. 235,790 is a continuation-in-part of application Ser. No. 97,997, filed Dec. 4, 1970, now abandoned. The entire disclosure of said U.S. Pat. No. 3,913,337 is incorporated herein by reference.

This invention relates to piling.

In present commercial practice, when bedrock is at a reasonable depth, high-capacity H pile steel sections, or open end or closed end pipe can be driven economically to capacities in excess of 100 tons. Compact sands and stiff clays will generally support H pile, steel pipe, mandrel-driven shell type piles, or pre-cast concrete pipe piles for capacities in excess of 50 tons and these piles are economical when the lengths are moderate.

However, there are situations where the soil conditions will not conveniently accommodate these specific piling types. For example along, and near, the sandy ocean beaches there are often great depths of relatively loose cohesionless materials. Here conventional piles must penetrate considerable distances to develop acceptable capacities by friction forces between the pile surface and the soil. In another situation, a thin layer of the relatively loose cohesionless material (usually situated underneath a non-bearing layer of silt, clay or fill or mixtures thereof) overlays a deep stratum of soil of very low bearing capacity such as soft clay. Here, when the pile is driven through the layer of loose material it must then be driven through the deep clayey layer to an acceptable bearing layer below the clay.

The piles of this invention are particularly suitable for use in supporting heavy loads on land in which the bearing soil is comparatively loose and granular, and not capable of sustaining high unit loads (e.g. soil of "N" value less than 30, say about 5 to 10) which soil may be situated below a relatively thick layer of soil unsuitable for bearing such as a fill or soft clay. In such cases it has been proposed to use a Franki type of pile, in which a mushroom base of concrete is pushed out at the bottom of the pile after the pile has been driven down to the bearing layer. Such piles are described at, for instance, pages 250–251 of the book "Pile Foundations Theory-Design-Practice" by Robert D. Chellis, published 1951 by McGraw-Hill, which also discusses a great many other types of piles known to the art. As pointed out by Chellis the Franki piles "are of particular advantage where a bearing stratum, of limited thickness only, can be reached within economical depths". While such Franki piles have, in many cases, large capacities (e.g. 120 tons per pile), their installation is quite complicated and very expensive; special costly equipment is needed and conventional automated pile-driving techniques cannot ordinarily be used. In addition the character of any individual driven pile is not readily predictable; I believe that this may be due, for instance, to eccentricities in the shape of the mushroom base of concrete that is rammed out of the bottom of the pile, and other factors.

Among the other piles which are in present commercial use in the loose soil conditions are the Raymond piles described on pages 233–235 of the Chellis book and the Monotube composite tapered pile which typically has a fluted heavy gauge shell which tapers down at its base. Where the loose granular soil layer is of limited thickness such piles tend to penetrate through that layer without attaining high capacities and must then be driven to considerable depths; even then the capacities do not approach those attainable using the piles of the present invention.

In accordance with one aspect of this invention there is provided a much less expensive pile, which can be installed economically with conventional automated techniques and which has high load bearing capacity in the soil conditions described above. Although the rated load bearing capacity of my new pile may be below that of a properly installed Franki pile, it is much higher than that of other conventional piles. The economy of installation makes it practical to overcome this lower bearing capacity by driving more of my new piles, so that the total cost for properly supporting a given building or other structure will be considerably lower when my new piles are used than when Franki piles are employed. The construction of my new pile is such that it can be driven rapidly, accurately, and easily, with good rigidity and stability of direction, by conventional automated pile driving hammers at high impact frequencies (e.g. 50 to 120 blows per minute using conventional hammers such as described at pages 70–72 of the Chellis book, the pile driving energy usually being in the range of about 15,000–36,000 foot pounds per blow).

Certain preferred forms of the invention are illustrated in the accompanying drawings in which FIG. 1 is a cross-sectional view, to scale, of one preferred type of pile tip in accordance with this invention.

FIG. 2 is a bottom view of the pile tip of FIG. 1.

FIG. 3 is a top view of the pile tip of FIG. 1.

FIG. 4 is a side view, also in cross-section, showing the pile tip of FIG. 1 connected to the stem of the pile and showing the pile being driven into the ground with a removable mandrel housed in a socket in the pile tip.

FIG. 5 is a side view, also in cross section, of a portion of the tip and the lower portion of the pile stem after concrete has been poured into the stem.

FIG. 6 is a cross-sectional view, to scale, of another form of pile tip in accordance with this invention, showing the pile tip connected to the tubular stem of the pile.

FIG. 7 illustrates schematically one way of driving the pile shown in FIG. 6.

FIG. 8 illustrates schematically another way of driving the pile shown in FIG. 6.

FIG. 9 is a side view, in cross section, of a portion of the tip of FIG. 6 and the lower portion of the pile stem after concrete has been poured into the stem.

FIG. 10 illustrates the use of a pile tip without a socket, and

FIG. 11 shows the use of a sleeve instead of a projecting stub for lining the socket.

Turning now to FIG. 1 the tip 11 is of reinforced concrete of symmetrically tapered frusto-conical construction with its base 12 being substantially flat (and in a plane substantially perpendicular to the axis 13 of the tip). The taper is gradual; in FIG. 1 it is about ½ inch per foot. The concrete tip is formed by casting in place around a relatively short length or stub of threaded (corrugated) steel shell 14 of conventional type leaving a substantially cylindrical central open socket 16 in the upper part of the concrete of the tip, and with a portion 17 of the stub projecting above the substantially flat top surface 18 of the concrete tip. It will be understood that the stub may be made of other metals or of other suitable materials, such as materials which, like metals, have a considerably higher tensile strength than concrete such as organic plastics (e.g. polycarbonate, such as "Lexan" or oxymethylene polymers such as "Celcon").

In FIG. 1 the reinforcement of the concrete is constituted by a series of equally spaced axially oriented reinforcing bars 19 disposed around the socket 16 and extending below the level of the base of the socket, the bars 19 being tied together by transverse reinforcing rods or bars 21 secured to bars 19 as by suitable means, e.g. wires tied around the bars. Instead of, or in addition to, reinforcing rods, the concrete may contain pieces of sheet metal distributed therethrough, or it may contain fibrous reinforcement (e.g. fibers of high tensile strength such as steel fibers of say 1/10 inch diamter, 1 to 2 inches long, occupying a small portion, such as 2%, of the total volume of the concrete).

In use, the tip 11 is connected to the stem 22 (FIG. 4) of the pile by a suitable connection, such as a threaded adapter 23, also of conventional shell construction, engaging both the projecting portion of the stub 14 and said stem. A mandrel 24 is disposed within the socket 16 (e.g. resting on a steel plate or boot which forms the base 26 of the socket; this plate preferably has a larger diameter than that of the stub and is put in place before the concrete of the tip is cast) for receiving the blow of the pile-driving hammer and transmitting its downward force to the concrete tip. The particular conventional mandrel shown in FIG. 4 extends the whole length of the stem. In FIG. 4 the upper portion is shown on a reduced scale and part of the lower portion is broken away to show details of the mandrel.

It will be apparent that the illustrated tip will stand stably in straight vertical position on its substantially flat base and can thus be placed straight up at the precise location where the pile is to be driven, remaining straight up at that location while the stem is attached and the mandrel is introduced, without the need for special support.

As the pile is driven, the tip penetrates through the non-bearing soil, until it reaches the bearing soil. Continued driving forces it into the latter, generally until the resistance to the driving force indicates that there is adequate load bearing capacity (e.g. using standard pile-driving formulas which relates load-bearing capacity to driving resistance and/or using actual static load tests in which the pile is loaded with twice the load it is expected to carry and the movement of the pile under such loading is measured, a movement of about one inch or less in this test generally being an indication that the pile will be satisfactory to carry the expected load).

The mandrel 24 may be of conventional construction. For instance it may be of the type having a pair of almost hemicylindrical halves 27 which, in use, are pressed apart against the internal walls of the shell (in this case, including the section of shell lining the socket 16). To this end there is an inflatable element 28 to which air (or other fluid) is admitted under pressure so as to expand the element 28 against the inwardly facing walls of the mandrel halves 27. When the mandrel is to be removed from the socket, the pressure in the inflatable element is reduced and the mandrel halves move together, away from the walls of the shell, under the influence of springs 29 mounted on rods 31 which pass through the mandrel halves; one end of each spring engages a wall of a mandrel half 27 while the other end is held at the outer end of its rod.

Another conventional type of mandrel which may be used is simply a heavy pipe extending through the stem and into the socket and resting on the base of the socket. For instance when the stem and socket each have a internal diameter of 13 inches, the mandrel may be a 12¾ inch outside diameter heavy-walled pipe which is driven by the hammer and transmits the driving force to the base 26 of the socket.

After removal of the mandrel, the shell (including the stub and the main stem of the pile) is filled with concrete. As shown in FIG. 5 the concrete fills the socket, making for an excellent connection between tip and stem so that they behave more as an integral unit even in response to tension forces. If desired, reinforcement, such as reinforcing rods 32, may be placed so as to extend from the cavity up into the stem before the concrete is poured. In FIGS. 1–5 it will be apparent that the construction and arrangement of the tip is such that the concrete filling of stem and central lined cavity or socket constitutes an integral concrete structure having substantially the same cross-section in said cavity as in said stem.

In the tip illustrated in FIGS. 6 to 9 the stub 34 is a short piece of pipe, e.g. straight-sided steel pipe having a diameter of about 8 to 14, or even 18, inches and having a wall thickness of about 0.17 to 0.4 inch or more; the tubular material conventionally used for pipe piles may be used. It is adapted to be joined to the stem 36 of a pipe pile by a connector, such as an internally tapered sleeve 37 whose internal diameter is about the same as the external diameter of the stub and stem, there being a drive fit between the sleeve 37 and the top of the stub and between the sleeve and the bottom of the stem; this connection may be formed by welding if desired. To assist in anchoring the stub in the concrete of the tip the stub of FIG. 6 may have welded to its base a flat transverse plate 38 of larger area than the cross-sectional area of the stub. This plate (e.g. of ½ inch thick steel) may be welded to the stub before the concrete of the tip is cast. The pile may be driven by pile-driving hammer blows at the top of the stem (FIG. 7) or, particularly when a thin-walled stem is used (which stem may even be of corrugated construction), it may be driven by such blows applied to an internal mandrel 24 (FIG. 8) in the socket 39 formed inside the stub 34. The plate 38 also helps to distribute the vertical pile driving forces more uniformly through the concrete tip. When the concrete is poured into the stem 36 it fills the socket 39, as shown in FIG. 9; here again reinforcement may be placed so as to extend from the cavity up into the stem.

The particular tips shown in the drawing are designed for use with a stem having a diameter of about 12 inches (for the embodiment of FIG. 6) or 14 inches (for the embodiment of FIG. 1). The base 12 of the tip has a diameter of about 24 inches, which is considerably larger than that of the stem. The maximum diameter of the tip, at the top, is about 30 inches and the axial height of the tip, measured from its base to the level at which its diameter attains its maximum, is about 60 inches, so that its taper is about 3/5 inch per foot.

In general, tips of this invention may be used with stems of about 8 to 18 inch diameter. The tip is preferably circular in cross section (although other cross-sections adapted to give a substantially uniform load distribution around the pile, e.g. square cross section, may be employed) and its projected area (at its maximum diameter) is above twice, and preferably about 5 to 15 times, the cross-sectional area of the stem. Preferably the base of the tip has a diameter of at least 8 inches, although the use of tips having differently shaped bases, e.g. pointed tips, is also within the broader scope of this invention. Preferably the axial height of the tip is at least two feet and at least 1 foot greater than the depth of the socket but less than ½, more usually less than ⅓, of the overall height of the pile (including the stem). The taper is generally less than 3 inches per foot (and preferably less than 1½ inches per foot) and above ¼ inch per foot (but it is within the broader scope of the invention to use an untapered tip). The depth of the socket is generally within the range of 1/10 to 9/10 of the axial height of the tip, preferably at least 3/10 and less than 7/10 of that height, more preferably about 0.4 to 0.6 times the height of the tip.

The use of the tip of this invention enables one to use shorter lengths of pile for a given load bearing capacity. Generally the overall length of the pile (including tip) will be in the range of about 10 to 50 feet or more.

The ground-engaging surfaces of the concrete tip may be smooth or textured (e.g. corrugated).

The "N" value, previously mentioned, is a conventional reference for soil compactness. It is the number of blows of a 140 lb. hammer, dropped from a height of 30 inches, required to advance a standard 2 inch diameter split spoon sampling tube a distance of 12 inches.

When the tip is driven through certain non-bearing soils, the soil does not flow back around the stem above the tip and there is an unfilled space around the stem. This space is preferably filled in, from the top, by dumping or otherwise placing material such as sand which may be applied dry or with water (e.g. it may be puddled or jetted in).

It is within the broader scope of this invention to drive piles having the tips of this invention into a bearing layer of soft rock. They may be driven, for instance, into a stratum of oolite, a porous limestone formation found, for instance, on the east coast of the state of Florida.

It is also within the broader scope of the invention to use a pile tip without a socket. For instance, as illustrated in FIG. 10 the tip 51 may have an upper plate 52, to which are welded downwardly extending reinforcing rods 53 (or other suitable anchoring means) around which the concrete 54 of the tip is cast, with the concrete being in contact with the lower face of the plate 52. A stub 56 (which may be a short length of pipe of the type used in the embodiment shown in FIG. 6) is welded to the top of the plate (either before or after the concrete of the tip is cast) to provide an attachment to the stem 57 of the pile. After driving the stem and stub are filled with concrete, as previously described.

While the tip of this invention is particularly suitable for use when attached to the longer stem of a pile, it is also within the broader scope of this invention to use the tip with a very short stem, or without any stem at all, as in situations in which piles or other driven elements have not been previously employed. For example, when the bearing soil (e.g. a fine to medium sand of "N" value about 8 to 10) is at, or very near, the surface and is not overlaid by other non-bearing strata of significant thickness, the tip itself (without a stem) may be driven directly into the surface, e.g. the tip illustrated in FIG. 1 may be driven some six feet into the soil by means of a conventional pile driving hammer operating on a mandrel within the socket of the tip. A spaced series of such driven tips (the axes of adjacent tips being spaced apart by a distance equal to say about 1½ times the largest diameter of the tip) can support a heavy building or other structure without the need for extensive excavation and without the need for large footings or mat foundations.

Instead of using a projecting stub for lining the socket of the concrete tip, one may employ a sleeve which does not project above the top of the concrete tip and which is adapted to be connected to the stem of the pile. In one suitable construction, illustrated in FIG. 11, this sleeve 61 is made of corrugated shell material of slightly larger diameter than the shell material of the pile stem 62 so that, after the tip has been fabricated and is ready for use, the stem can be attached to the tip by screwing it into the sleeve 61. The stem can also be attached by screwing it directly into an otherwise unlined socket having integral concrete threads adapted to engage the lower end of the stem directly without an intervening liner; in this case, the concrete is cast around a suitable form (which may have the same configuration as the stub or sleeve, previously mentioned) and that form is removed after casting of the tip, leaving an internally threaded concrete-surfaced socket into which the stem is screwed before the pile is driven. Alternatively the unlined socket may be unthreaded but adapted to be frictionally connected to the stem; thus the socket may have straight slightly tapered walls (defining, for instance, a frustum of a downwardly pointed cone) and the lower end of the stem (which may be correspondingly tapered) may be pushed into the socket so that there is a force fit between stem and socket. On the lower end of the stem may be bonded to the inner walls of the unlined socket by means of a suitable cement. The stem can also be attached by screwing it into a lined socket, whose liner is of slightly larger diameter than that of the stem. It will also be seen that in these cases the lower end of the stem serves also as all or part of the liner of the socket.

The present invention makes it possible for relatively large volumes of concrete, comparable to the volumes of extruded material in Franki piles, to be more economically put in place in deeper strata and with more uniform results. As with the Franki piles, the piles of the present invention give their results largely by the compaction of the soil of low bearing value and they attain very high load bearing capacity in relatively shallow strata. Typical examples of such conditions are as follows: (a) 18 feet of miscellaneous fill and gray clayey organic silt overlying a 15 foot thick layer (of N value about 25) of fine silty sand (containing some medium gravel) overlying more than 50 feet of clay; (b) 15 feet of miscellaneous fill, peat and gray slit overlying a 10 foot thick layer of medium to fine loose sand (N value about 12) overlying another 50 feet of red brown silty fine sand; (c) 10 to 15 feet of fill overlying 1 to 4 feet of peat and an underlying layer of loose sand of N value of 6 to 30.

The present invention also makes it possible to drive the pile accurately in the desired direction. One factor in this is the presence, during driving, of the rigid mandrel within the socket which helps to insure that the tip does not become deflected by localized variation in soil resistance, e.g. boulders, debris, uneven strata, etc. Any appreciable deflection tendency will cause a portion of the inner wall of the socket to press hard against the corresponding outer wall of the sturdy rigid mandrel which will resist such deflection.

The particular tip size can of course be adjusted in accordance with the desired load bearing capacity. Thus as between (a) a tip having a height of 34 inches, and diameters of 20 inches at its base, and 24 inches at the top on a $10\frac{3}{4}$ inch diameter stem and (b) a tip having a height of 60 inches, and diameters of 23 inches at its base and 29 inches at the top, on a $12\frac{3}{4}$ inch diameter stem, the load bearing capacity was higher for the larger tip but the small tip is more economical to fabricate and drive.

The piles of this invention are easily inspected and tested. Thus, if the tip should be seriously defective (e.g. cracked) this can be readily detected since driving characteristics of the pile will be as if there were no tips. The stem of the driven pile can be readily inspected by visual methods before the concrete is poured into it.

It is understood that the foregoing detailed description is given merely by way of illustration and the variations may be made therein without departing from the spirit of the invention.

I claim:

1. A tip for a pile having a tubular metal stem, which stem is filled with concrete after the pile is driven, said tip being of reinforced concrete and having an upper central cavity adapted to receive said filling of concrete, said tip being tapered to increase in diameter from the bottom upwards, the maximum cross-sectional area of the tip being about 5 to 15 times the cross-sectional area of the stem, the taper being less than about 3 inches per foot and the axial height of said tip being at least about 2 feet, and in which said tip has an upper central tubular liner rigidly embedded in the concrete of said tip and to which the stem is adapted to be attached before said pile is driven, the construction and arrangement of said tip being such that said concrete filling of said stem and central cavity constitutes an integral concrete structure having substantially the same cross-section in said cavity as in said stem.

2. A tip as in claim 1 in which the base of said tip has a diameter of at least 8 inches, said base diameter being larger than the diameter of said stem, and the taper of said tip is above $\frac{1}{4}$ inch per foot and less than 3 inches per foot.

3. A tip as in claim 2, of substantially circular cross-section, for a stem having a diameter of about 8 to 18 inches, in which said liner is a short length of threaded corrugated metal shell, the depth of said cavity is at least 3/10 of the axial height of said tip, and less than 7/10 of that height, said axial height is at least one foot greater than the depth of said cavity, and said cavity is of sufficient size to house a driving mandrel whereby the force of the pile driving hammer is transmitted to the bottom of said cavity.

4. A tip as in claim 3, for a stem having a diameter of about 12 inches, said tip having a flat base with a diameter of about 24 inches, an axial height of about 60 inches, a maximum diameter, at the top, of about 30 inches.

5. A tip for a pile having a tubular metal stem, which stem is filled with concrete after the pile is driven, said tip being of reinforced concrete and having an upper central cavity adapted to receive said filling of concrete, said tip being tapered to increase in diameter from the bottom upwards, the maximum cross-sectional area of the tip being about 5 to 15 times the cross-sectional area of the stem, the taper being less than about 3 inches per foot and the axial height of said tip being at least about 2 feet and in which the base of said tip has a diameter of at least 8 inches, the axial height of said tip is at least two feet and at least 1 foot greater than the depth of said cavity, the depth of said cavity being about 0.4 to 0.6 times said axial height, the construction and arrangement of said tip being such that said concrete filling of said stem and central cavity constitutes an integral concrete structure having substantially the same cross-section in said cavity as in said stem.

* * * * *